United States Patent [19]

Rasser

[11] 4,297,230

[45] Oct. 27, 1981

[54] NON-CRYSTALLIZING TRANSPARENT SOAP BARS

[75] Inventor: Jacobus C. Rasser, Grimbergen, Belgium

[73] Assignee: The Procter & Gamble Company, Cincinnati, Ohio

[21] Appl. No.: 117,320

[22] Filed: Jan. 31, 1980

[30] Foreign Application Priority Data

Feb. 6, 1979 [GB] United Kingdom ..... 04197/79
Nov. 1, 1979 [GB] United Kingdom ..... 37809/79

[51] Int. Cl.[3] ..... C11D 9/30; C11D 3/10

[52] U.S. Cl. ..... 252/117; 252/108; 252/109; 252/132; 252/134; 252/DIG. 16

[58] Field of Search ..... 252/108, 109, 132, 134, 252/DIG. 16

[56] References Cited

U.S. PATENT DOCUMENTS

| | | | |
|---|---|---|---|
| 2,686,761 | 8/1954 | Ferguson et al. | 252/109 |
| 2,970,116 | 1/1961 | Kelly et al. | 252/368 |
| 3,043,779 | 7/1962 | Parke et al. | 252/117 |
| 3,274,119 | 9/1966 | Goldwasser et al. | 252/368 |
| 3,494,869 | 2/1970 | Armstrong | 252/109 |
| 3,507,797 | 4/1970 | Mazumder | 252/110 |
| 3,557,006 | 1/1971 | Farrara et al. | 252/117 |
| 3,562,167 | 2/1971 | Kamen et al. | 252/121 |
| 3,576,749 | 4/1971 | Megson et al. | 252/132 |
| 3,793,214 | 2/1974 | O'Neill et al. | 252/117 |

FOREIGN PATENT DOCUMENTS

| | | |
|---|---|---|
| 580206 | 7/1959 | Canada . |
| 1457935 | 12/1965 | France . |
| 1460442 | 1/1977 | United Kingdom . |

*Primary Examiner*—P. E. Willis, Jr.

[57] ABSTRACT

Soap bars, which contain at least about 1% potassium soap and 0.15% chloride anions, and which additionally comprise water and a selected sodium potassium or ammonium salt electrolyte, particularly potassium carbonate, dipotassium monohydrogen orthophosphate, tetrapotassium pyrophosphate, potassium tripolyphosphate, tripotassium orthophosphate, or sodium and/or potassium formates, citrates, tartrates, or acetates, are disclosed. These soap bars do not form undesirable crystals, either on their surfaces or internally, after periods of use or storage and, additionally, exhibit improved lathering performance and decreased scum formation.

10 Claims, No Drawings

NON-CRYSTALLIZING TRANSPARENT SOAP BARS

BACKGROUND OF THE INVENTION

A wide variety of soap bars and methods of making such soaps are known in the art. Many soap-making processes, such as those described in U.S. Pat. No. 2,686,761, Ferguson et al., issued Aug. 17, 1954, and U.S. Pat. No. 2,970,116, Kelly et al., issued Jan. 31, 1961, both of which are incorporated herein by reference, utilize electrolytes, such as sodium chloride and potassium chloride, as processing aids. Thus, such soaps frequently contain significant amounts of chloride anions. In addition, it has been found to be advantageous to utilize potassium soaps as, at least, a portion of soap compositions; this is especially true where the soap to be manufactured is transparent, since the presence of the potassium soap enhances transparency.

It has been found, however, that the presence of significant levels of both potassium soap and chloride anions in a soap bar leads to the formation of crystals on the surface or the interior of the bar, after use or storage, particularly under hot and humid conditions. Such crystals detract from the appearance and consumer desirability of these soaps. It has now been discovered that by utilizing specific electrolytes in such soap bars this crystallization problem can be eliminated, while endowing the soaps with additional performance advantages.

It is, therefore, an object of the present invention to provide a soap bar, especially a transparent soap bar, containing significant levels of potassium soap and chloride anions, which does not form crystals upon use or storage.

It is a further object of this invention to provide a soap bar which exhibits better lather and decreased scum formation properties than similar bars made with conventional electrolytes.

It is a still further object of this invention to provide a transparent soap bar which has better transparency characteristics than similar soaps made with conventional electrolytes.

DESCRIPTION OF THE INVENTION

The present invention is a soap bar which does not form undesirable crystals upon use or storage, and which contains at least about 1% potassium soap and at least about 0.15% chloride anions, comprising from about 4% to about 25% moisture and from about 0.2% to about 5%, preferably from about 0.5% to about 3%, of an electrolyte selected from the group consisting of potassium carbonate, dipotassium monohydrogen orthophosphate, tetrapotassium pyrophosphate, potassium tripolyphosphate, tripotassium orthophosphate, sodium formate, potassium formate, potassium tartrate, sodium tartrate, potassium citrate, sodium citrate, potassium acetate, sodium acetate, potassium ammonium tartrate, ammonium acetate, ammonium carbonate, ammonium formate, ammonium citrate, ammonium lactate, ammonium bisulfate, and mixtures thereof. Preferred compositions contain electrolytes selected from potassium carbonate, dipotassium monohydrogen orthophosphate, tetrapotassium pyrophosphate, potassium tripolyphosphate, tripotassium orthophosphate, and mixtures thereof. Another preferred group of electrolytes includes sodium and/or potassium formates, citrates, acetates, and tartrates. In a particularly preferred embodiment of the present invention, the soap bar is made from a transparent soap.

As used herein, percentages, ratios and parts are "by weight" and are based on the composition of the finished soap, unless otherwise stated.

The soap bars of the present invention are comprised mainly of a soap component. This component is generally present in an amount of from about 60% to about 95%, preferably from about 65% to about 85%, of the finished soap. Soaps useful in the present invention include the alkali metal, ammonium and alkanolamine salts of fatty acids containing from about 8 to 24, preferably 10 to 20, carbon atoms. The compositions of the present invention must contain at least about 1%, preferably at least about 2.5%, most preferably at least about 4%, of a potassium soap. In one embodiment, the soap bars of the present invention contain at least about 7%, more preferably from about 7% to about 20%, particularly from about 10% to about 17%, of a potassium soap. The potassium soap may be added per se to the compositions or else it may be formed in situ during processing (e.g. by including both a sodium soap and a potassium electrolyte in the soap bar). The presence of such a component is an important factor contributing to the crystallization problem which this invention seeks to solve. Since the utilization of potassium soap is highly desirable, especially in the manufacture of transparent soaps, the present invention provides a solution to this problem which is preferable to the elimination of these potassium soaps.

Fatty acids, suitable for use herein, can be obtained from natural sources such as, for instance, plant or animal esters (e.g., palm oil, coconut oil, babassu oil, soybean oil, castor oil, tallow, whale or fish oils, grease, lard, and mixtures thereof). The fatty acids can also be synthetically prepared (e.g., by the oxidation of petroleum, or by the hydrogenation of carbon monoxide by the Fischer-Tropsch process). Resin acids, such as those present in tall oil, may be used. Naphthenic acids are also suitable.

Sodium and potassium soaps can be made by direct saponification of the fats and oils or by the neutralization of the free fatty acids which are prepared in a separate manufacturing process. Particularly useful in the present invention are the sodium and potassium salts of mixtures of fatty acids derived from coconut oil and tallow, i.e., sodium and potassium tallow and coconut soaps.

The term "tallow" is used herein in defining fatty acid mixtures having an approximate carbon chain length distribution of 2.5% $C_{14}$, 29% $C_{16}$, 23% $C_{18}$, 2% palmitoleic, 41.5% oleic and 3% linoleic acids (the first three fatty acids listed being saturated). Other mixtures with similar distributions, such as fatty acids derived from various animal tallows and lard, are also included within the term tallow.

The term "coconut oil", as used herein, refers to fatty acid mixtures having an approximate carbon chain length distribution of: 8% $C_8$, 7% $C_{10}$, 48% $C_{12}$, 17% $C_{14}$, 8% $C_{16}$, 2% $C_{18}$, 7% oleic and 2% linoleic acids (the first six fatty acids listed being saturated). Other sources having similar carbon chain length distributions, such as palm kernel oil and babassu kernel oil, are included within the term coconut oil. Coconut oil fatty acids ordinarily have a sufficiently low content of unsaturated fatty acids to have satisfactory keeping qualities without further treatment. Generally, however, the fatty acids are hydrogenated to decrease the amount of unsaturation (especially polyunsaturation) of the fatty acid mixture.

In preferred soap bars, the soap component comprises from about 20% to 80% of a mixture containing soaps having from 8 to 14 carbon atoms, and from about 20% to 80% of soaps having from about 16 to 20 carbon atoms. Soaps having such preferred chain length distribution characteristics can be obtained by using mixtures of tallow and coconut fatty acids in tallow/coconut weight ratios varying between 90:10 and 50:50, more preferably between about 80:20 and 60:40. The compositions of the present invention are particularly effective in inhibiting crystal growth when the mixture of tallow and coconut fatty acids contains at least about 15%, and preferably at least about 20%, of the coconut fatty acid component.

Preferred soap bars containing the above-described soap mixtures, as well as their manufacture, are described in detail in Megson et al., U.S. Pat. No. 3,576,749, issued Apr. 27, 1971, White, U.S. Pat. No. 3,835,058, issued Sept. 10, 1974, and Seiden, U.S. Pat. No. 3,988,255, issued Oct. 26, 1976, all of which are incorporated herein by reference.

Another factor in creating the crystallization problem which the present invention seeks to solve is the presence of a significant amount of chloride anions in the soap composition; thus, the soap bars of the present invention must contain at least about 0.15%, particularly at least about 0.2%, and most particularly from about 0.2% to about 0.7%, of chloride anions. Chloride anions are generally introduced into soap compositions in the form of sodium chloride or potassium chloride electrolytes which are used to improve the processing (i.e. the separation of the soap from the alkaline materials) or the transparency of a soap composition.

The heart of the present invention lies in the addition of from about 0.2% to about 5%, preferably from about 0.5% to about 3%, and most preferably from about 1% to about 3%, of specific electrolyte materials to the soap compositions defined herein. It is by the selection and the inclusion of these specific electrolytes that the crystallization negative, previously discussed, can be eliminated from soap bar compositions. Generally, the electrolytes are selected so that they have a relatively bulky anion and a water solubility which is significantly greater than that of sodium chloride (i.e., at least about 100 g/100 ml in 25° C. water). The electrolytes useful in the present invention include potassium carbonate, dipotassium monohydrogen orthophosphate ($K_2HPO_4$), tetrapotassium pyrophosphate ($K_4P_2O_7$), potassium tripolyphosphate ($K_5P_3O_{10}$), tripotassium orthophosphate ($K_3PO_4$), potassium formate, sodium formate, sodium tartrate, potassium tartrate, sodium citrate, potassium citrate, sodium acetate, potassium acetate, potassium ammonium tartrate, ammonium acetate, ammonium carbonate, ammonium formate, ammonium citrate, ammonium lactate, ammonium bisulfate, and mixtures of these components. Preferred compositions are those utilizing potassium carbonate, dipotassium monohydrogen orthophosphate, tetrapotassium pyrophosphate, potassium tripolyphosphate, tripotassium orthophosphate, or mixtures of these components, as the electrolyte, with particularly preferred compositions utilizing potassium carbonate or dipotassium monohydrogen orthophosphate, especially potassium carbonate. In addition, the electrolytes utilized, particularly the carbonate and phosphate electrolytes, provide the soap bars of the present invention with superior lathering characteristics and reduced scum (i.e., calcium and magnesium soap) formation when compared with soap bars utilizing conventional electrolytes.

Another preferred group of compositions are those which include sodium and/or potassium (particularly potassium) formates, citrates, acetates and tartrates (especially those which include potassium citrate). These compositions offer advantages over those containing potassium carbonate in that they: (a) eliminate crystal formation in the interior of the soap bar (particularly important in transparent soap bars); (b) exhibit improved lather formation in hard water; (c) exhibit improved translucency; (d) require less mechanical work to obtain translucency; and (e) exhibit improved component (especially perfume and coloring) stability, since these preferred electrolytes complex heavy metal ions thereby reducing component oxidation.

The present invention is particularly effective when used in milled, transparent soap bars, such as those described in U.S. Pat. No. 2,686,761, Ferguson et al., issued Aug. 17, 1954, incorporated herein by reference. Such soap bars preferably have a high level, such as at least about 70%, of beta-phase material, as described in the above-incorporated patent.

The soap bars of the present invention inevitably contain some moisture (water). Moisture aids in the processing of the soap bars herein and is required for optimum processing conditions. Generally, the finished soap bars of this invention include from about 4% to about 25% by weight, preferably from about 10% to about 23% by weight, moisture.

In addition to the components described above, the soap bars of the present invention can contain a wide variety of optional materials. These optional materials include, for example, skin conditioning components, free fatty acids, processing aids, anti-bacterial agents and sanitizers, dyes, perfumes and coloring agents.

The soap bars of the present invention can optionally contain free fatty acids, in addition to the neutralized fatty acids which form the actual soap component. Free fatty acids improve the volume and especially the quality of the lather from the bar. Free fatty acids tend to cause the lather to be more stable, containing smaller air bubbles, which give the user a lather which is characterized as "richer" and creamier. In addition, in soap bars which contain large amounts of salt, the free fatty acids act as plasticizers. Without the free fatty acids, some bars have a greater tendency to form wet cracks.

Free fatty acids useful in the present invention include the same types of fatty acids used to form the soap component. Such fatty acids generally contain from 8 to 20, preferably from 8 to 14, carbon atoms. In preferred soap bars, at least about 25% of the free fatty acid component is the $C_{12}$ fatty acid. If present, free fatty acid generally comprises from about 1% to about 15% by weight of the bar. Use of free fatty acid in soap bars is described in more detail in Megson et al., U.S. Pat. No. 3,576,749, issued Apr. 27, 1971, and White, U.S. Pat. No. 3,835,058, issued Sept. 10, 1974, both of which are incorporated herein by reference.

Materials to facilitate the preparation of the instant soap bars can also be present. Thus, salt (sodium chloride) and preferably, glycerine, for example, can be added to the crutcher or amalgamator in order to facilitate processing of the soap bars. Such materials, if present, generally comprise from about 0.2% to about 10% by weight of the finished soap bar. Additionally, emulsifiers such as polyglycerol esters (e.g. polyglycerol monostearate), propylene glycol esters and other chemically stable nonionic materials may be added to the bars to help solubilize various components, particularly skin conditioning agents, such as sorbitan esters.

Conventional anti-bacterial agents and sanitizers can be added to the soap bars of the present invention without adversely affecting their crystal inhibition properties. Typical anti-bacterial sanitizers include 3,4-di- and 3,4',5-tri-bromosalicyl-anilides; 4,4'-dichloro-3-(trifluoromethyl) carbanilide; 3,4,4'-chlorocarbanilide and mixtures of these materials. Use of these materials in soap bars is described in more detail in Reller et al., U.S. Pat. No. 3,256,200, issued June 14, 1966, incorporated herein by reference. If present, anti-bacterial agents and sanitizers generally comprise from about 0.5% to about 4% by weight of the finished soap bar.

The soap bars of the present invention can optionally contain various emollients and skin conditioning agents. Materials of this type include, for example, sorbitan esters, such as those described in Seiden, U.S. Pat. No. 3,988,255, issued Oct. 26, 1976, incorporated herein by reference, lanolin, cold cream, mineral oil, isopropyl myristate, and similar materials. If present, such emollients and skin conditioning agents generally comprise from about 0.5% to about 5% by weight of the soap bar.

The soap bars can also contain any of the conventional perfumes, dyes and coloring agents generally utilized in commercially-marketed soap bars to improve the characteristics of such products. If present, such perfumes, dyes and coloring agents comprise from about 0.2% to about 5% by weight of the soap bar.

The soap bars of the present invention are prepared in a conventional manner. Moisture-containing base soap of the type described above, having the requisite potassium soap and chloride anion content, is admixed with the electrolyte component defined herein, and other optional components, such as perfumes, in a crutcher or amalgamator, milled in conventional manner under conventional conditions and extruded into logs for stamping into soap bars. Conventional processes for preparing transparent soap bars can also be utilized. Manufacturing processes for preparing soap bars of the type claimed herein are described in more detail in White, U.S. Pat. No. 3,835,058, issued Sept. 10, 1974, Megson et al., U.S. Pat. No. 3,576,749, issued Apr. 27, 1971, and Bradley et al., U.S. Pat. No. 3,523,909, issued Aug. 11, 1970, all of which are incorporated herein by reference.

The soap bars of the present invention, their benefits in terms of crystal growth inhibition, and their utility in conventional hand and body washing operations are illustrated by the following, non-limiting examples.

EXAMPLE I

A. Soap bars, having the compositions given below, were prepared in the following manner. Dried sodium tallow/coconut (80/20) soap was mixed in an amalgamator with one, some, or all of the ingredients indicated in following table: triethanolamine (TEA), glycerine, potassium coconut soap, and potassium chloride. The mix was then milled to maximum transparency, which was usually obtained after 4 passes over a 3 roll mill. When potassium coconut soap was added to the soap bars, drying over hot mills prior to cold milling, was necessary. The soaps of the present invention may also be produced by mixing the sodium and potassium soaps in a crutcher, drying the mixture in a vacuum flashdryer to the desired moisture level, and mixing in the remaining components in an amalgamator.

| | Weight % (finished product) Composition No. | | | | | | |
|---|---|---|---|---|---|---|---|
| | 1 | 2 | 3 | 4 | 5 | 6 | 7 |
| Sodium tallow/(80/20) soap | 83 | 78 | 73 | 71 | 66 | 60 | 64 |
| TEA | — | — | 4 | — | — | — | 2 |
| Glycerine | — | 6 | 6 | 6 | 6 | 6 | 6 |
| Potassium coconut soap | — | — | 13 | 5 | 10 | 16 | 10 |
| Sodium chloride | 0.6 | 0.6 | 0.6 | 0.5 | 0.5 | 0.4 | 0.5 |
| Potassium chloride | — | — | — | 0.5 | 0.9 | 0.2 | 0.5 |
| Water | 15 | 14 | 13 | 17 | 17 | 17 | 17 |
| Minors | balance to 100 | | | | | | |

These soap bars were then tested for transparency, lather, and crystal growth, using the methods described below.

The transparency of these soap bars was determined by measuring the transmission of light through each bar, as described in U.S. Pat. No. 2,970,116, Kelly et al., issued Jan. 31, 1961, incorporated herein by reference. In this method, the bar soap is placed in a completely dark room, on top of a cone section surrounding a light source of variable voltage. The cone section has a diameter of approximately ½ inch at the top and 2½ inches at the base, which surrounds the face of the light; the top of the cone section is about 9½ inches above the face of the lamp; and the lamp is a microscope lamp with a 220 V, 15 watt clear glass bulb. The voltage across the bulb is adjusted until the light from the top of the cone section shines through a bar having a thickness of 2.75 cm and forms a barely perceptible circular image. The voltage across the bulb is used as a measure of transparency, which is independent of color; thus, a lower voltage indicates a more transparent bar.

The lathering performance of the soap bars was tested in the manner described in Belgian Pat. No. 823,776, incorporated herein by reference. In the test used herein, the panelists did not wear gloves when lathering the soap bars and the lather achieved was graded comparatively in arbitrary units. At least 4 panelists are required to duplicate the test, and the results are averaged over the number of panelists involved. Higher lather grades indicate better lathering performance.

Crystal growth properties were tested by means of the visual examination of the surfaces and interior of the bars after they were subjected to various storage and usage conditions; specifically, the bars were observed:

(a) after storage under ambient conditions;
(b) after storage under conditions of accelerated aging (50° C., 50% relative humidity);
(c) after repeated usage (4 times a day for one week) and subsequent storage under ambient conditions.

The performance of the soap bars, under each of these tests, is summarized in the following table.

| Composition No. | Transparency (voltage) | Lather (Arbitrary Units) | Crystal Growth |
|---|---|---|---|
| 1 | opaque | 40 | no |
| 2 | 122 | 45 | no |
| 3 | 45 | 45 | no |
| 4 | 103 | 50 | few |
| 5 | 44.0 | 57 | yes |
| 6 | 54.4 | 57 | yes |

-continued

| Composition No. | Transparency (voltage) | Lather (Arbitrary Units) | Crystal Growth |
|---|---|---|---|
| 7 | 82.3 | 58 | no |

This table indicates that the inclusion of potassium soap in the soap bars yields a high degree of transparency and a significant lather benefit, but that the presence of such potassium soaps leads to undesirable crystal formation in the soap bars. It should also be noted that while triethanolamine may be included to avoid the crystal growth problem, while still maintaining the lathering benefit, the inclusion of TEA leads to a precipitous drop in the transparency of the soap.

B. Using the method of manufacture described above, soap bars were made by the direct saponification of tallow/coconut (65/35) fatty acid with a 50/50 mixture of sodium hydroxide and potassium hydroxide, using sodium chloride or potassium chloride as an electrolyte, as indicated in the table below. The soap bars contained from about 15% to about 18% moisture. The transparency and the crystal growth properties of the soap bars formed were tested as described above.

| Composition No. | NaCl added | KCl added | Transparency (volts) | Crystal Growth |
|---|---|---|---|---|
| 8 | — | — | opaque | no |
| 9 | 0.6% | — | 118 | yes |
| 10 | 1.25% | — | 80.9 | yes |
| 11 | — | 0.3% | 75.0 | yes |
| 12 | — | 0.6% | 58.4 | yes |
| 13 | — | 1.3% | 44.2 | yes |

These tests demonstrate a definite increase in transparency which is achieved by the incorporation of an electrolyte into the soap compositions. However, the presence of the conventional electrolytes tested leads to the formation of undesirable crystal in the soap bar.

C. Utilizing the method of manufacture described above, soap bars were made having a final composition of 62.4% of sodium tallow/coconut (80/20) soap, 10.4% of potassium coconut soap, 6.0% of glycerine, and the indicated percentages of the additional components specified in the table below. The soap bars contained from about 15% to about 18% moisture. These soap bars were then tested for transparency and crystal growth characteristics, using the procedures described above.

| Composition No. | NaCl | KCl | $K_2CO_3$ | Coconut Fatty Acid | Transparency (Volts) | Crystal Growth |
|---|---|---|---|---|---|---|
| 14 | 0.48% | 1.0 | — | — | 38.2 | yes |
| 15 | 0.48% | — | 1.0 | — | 46.6 | no |
| 16 | 0.48% | — | 1.5 | — | 40.3 | no |
| 17 | 0.48% | — | 2.0 | — | 35.6 | no |
| 18 | 0.48% | 1.0 | — | 2.0 | 62.1 | yes |
| 19 | 0.48% | — | 2.0 | 2.0 | 40.4 | no |

It is seen that the compositions of the present invention (compositions 15, 16, 17, and 19) had good transparency characteristics and did not grow crystals, while the soap compositions which utilized only the conventional sodium chloride and potassium chloride electrolytes manifested undesirable crystal growth.

Substantially similar results are obtained where the potassium carbonate electrolyte in compositions 15, 16, 17, or 19, is replaced in whole or in part by dipotassium monohydrogen orthophosphate, tetrapotassium pyrophosphate, potassium tripolyphosphate, tripotassium orthophosphate, sodium formate, potassium formate, sodium tartrate, potassium tartrate, sodium citrate, potassium citrate, sodium acetate, potassium acetate, potassium ammonium tartrate, ammonium acetate, ammonium carbonate, ammonium formate, ammonium citrate, ammonium lactate, ammonium bisulfate, and mixtures of these components.

EXAMPLE II

The lathering characteristics of soap bar compositions of the present invention were compared to those of soap bars utilizing the sodium chloride and potassium chloride electrolytes well-known in the art, using the procedure described in Example I, above.

Using the method described in Example I, soap bars containing 62.4% sodium (80/20) tallow/coconut soap, 10.4% potassium coconut soap, 6.0% glycerine, and the additional components in the amount specified below, were made. The soap bars were tested for lathering performance in both in tap water (hardness = 17 grains/gallon) and distilled water. The soap bars contained from about 15% to about 18% moisture.

| Composition No. | NaCl | KCl | $K_2CO_3$ | $K_2HPO_4$ | Coconut Fatty Acid | Lather (tap water) | Lather (distilled water) |
|---|---|---|---|---|---|---|---|
| 14 | 0.48 | 1.0 | — | — | — | 57.5 | — |
| 17 | 0.48 | — | 2.0 | — | — | 57.5 | — |
| 20 | 0.48 | — | — | 2.0 | — | 79.6 | 83.2 |
| 18 | 0.48 | 1.0 | — | — | 2.0 | 66.6 | 56.0 |
| 19 | 0.48 | — | 2.0 | — | 2.0 | 69.0 | 73.9 |
| 21 | 0.48 | — | — | 2.0 | 2.0 | 85.2 | 105.7 |

EXAMPLE III

The compositions, described in the table below, exemplify various embodiments of the soap bars of the present invention. These soap bar compositions may be manufactured in any of the conventional ways described in the present application and, specifically, may be manufactured using the method described in Example I, above. It is to be appreciated that similar compositions may be made by substituting other conventional electrolytes, such as potassium chloride, for sodium chloride, specified below; by substituting other fatty acids for the coconut fatty acid, specified below; or by substituting dipotassium monohydrogen orthophosphate, tetrapotassium pyrophosphate, potassium tripolyphosphate, tripotassium orthophosphate, sodium formate, potassium formate, sodium tartrate, potassium tartrate, sodium citrate, sodium acetate, potassium acetate, potassium ammonium tartrate, ammonium acetate, ammonium carbonate, ammonium formate, ammonium citrate, ammonium lactate, ammonium bisulfate, or mixtures of these compounds, in whole or in part, for the potassium carbonate or potassium citrate electrolytes, specified below.

In the table below, the ingredients referred to as A, B, C, D, E, etc. have the following meaning:

A-Sodium tallowate
B-Sodium cocoate
C-Potassium tallowate
D-Potassium cocoate
E-Sodium chloride
F-Potassium carbonate
G-Potassium citrate
H-Coconut fatty acid
I-Glycerine
J-Polyacrylamide
K-Water
L-Minor components, such as perfume, colorants, etc.

| | WEIGHT % | | | | | | | | | | | | |
|---|---|---|---|---|---|---|---|---|---|---|---|---|---|
| | COMPOSITION NO. | | | | | | | | | | | | |
| COMPONENT | 22 | 23 | 24 | 25 | 26 | 27 | 28 | 29 | 30 | 31 | 32 | 33 | 34 |
| A | 55.08 | 53.64 | 47.12 | 64.6 | 31.5 | 49.72 | 42.41 | 34.88 | 40.20 | 38.4 | 56.6 | 57.6 | 56.3 |
| B | 13.77 | 13.41 | 11.78 | 11.4 | 31.5 | 12.43 | 22.83 | 23.25 | 10.05 | 25.6 | 14.1 | 14.4 | 14.1 |
| C | 6.12 | 5.96 | 8.32 | 3.4 | 7.0 | — | 4.71 | 11.63 | — | 6.1 | — | — | — |
| D | 1.53 | 1.49 | 2.08 | 0.6 | — | 10.36 | 2.54 | 7.75 | 16.75 | 4.0 | — | — | — |
| E | 0.5 | 0.5 | 0.25 | 0.5 | 0.5 | 0.5 | 0.5 | 0.3 | 0.25 | 0.4 | 0.5 | 1.0 | 0.5 |
| F | 1.0 | 2.0 | 2.5 | 1.5 | 2.5 | — | — | — | — | — | — | — | — |
| G | — | — | — | — | — | 2.0 | 2.0 | 0.5 | 3.0 | 2.8 | 2.8 | 1.0 | 2.8 |
| H | 2.0 | 2.0 | 5.0 | — | 5.0 | 2.0 | 2.0 | 2.0 | 5.0 | — | — | — | — |
| I | 3.0 | 6.0 | 6.0 | 3.0 | 3.0 | 6.0 | 6.0 | 3.0 | 6.0 | 6.0 | 4.0 | 4.0 | 4.0 |
| J | — | — | — | — | — | — | — | — | — | — | — | — | 0.3 |
| K | 15.0 | 13.0 | 15.0 | 13.0 | 17.0 | 15.0 | 15.0 | 15.0 | 17.0 | 15.0 | 20 | 20 | 20 |
| L | BALANCE TO 100 | | | | | | | | | | | | |

I claim:

1. A transparent soap bar, consisting essentially of from about 4% to about 20% potassium soap, the balance of the soap component of said soap bar comprising sodium, ammonium or alkanolamine soap, at least about 0.2% chloride anions, from about 4% to about 25% moisture and from about 0.2% to about 5% of an electrolyte selected from the group consisting of potassium carbonate, sodium formate, potassium formate, sodium tartrate, potassium tartrate, sodium citrate, potassium citrate, sodium acetate, potassium acetate, potassium ammonium tartrate, ammonium acetate, ammonium carbonate, ammonium formate, ammonium citrate, ammonium lactate, ammonium bisulfate, and mixtures thereof.

2. A soap bar according to claim 1 which contains from about 0.5% to about 3% of said electrolyte.

3. A soap bar according to claim 2 wherein said electrolyte is selected from the group consisting of potassium formate, potassium citrate, potassium acetate, potassium tartrate, sodium formate, sodium citrate, sodium acetate, sodium tartrate, and mixtures thereof.

4. A soap bar according to claim 3 wherein said electrolyte is potassium citrate.

5. A soap bar according to claim 1, which is milled and contains at least about 70% beta phase material.

6. A soap bar according to claim 1 which additionally contains from about 0.2% to about 10% glycerine.

7. A soap bar, characterized in that it comprises from about 1% to about 20% potassium soap, the balance of the soap component of said soap bar comprising sodium, ammonium or alkanolamine soap, at least about 0.15% chloride anions, from about 4% to about 25% moisture and from about 0.5% to about 3% of potassium carbonate electrolyte.

8. A transparent soap bar which does not form crystals upon use or storage, comprising from about 1% to about 20% potassium soap, the balance of the soap component of said soap bar comprising a mixture of sodium soaps of coconut and tallow fatty acids, at least about 0.15% chloride anions, from about 4% to about 25% moisture and from about 0.2% to about 5% of potassium citrate.

9. In a method of manufacturing a transparent soap bar comprising the usual steps of milling or otherwise mechanically working the sodium soap of coconut or tallow fatty acids, or mixtures thereof, said soap containing sodium chloride as a processing aid, thereby imparting transparency to said soap, and thereafter extruding or otherwise forming the worked soap into bars, the improvement which comprises adding from about 0.2% to about 5% by weight of an electrolyte selected from the group consisting of potassium citrate, potassium tartrate and potassium carbonate to the soap prior to or during mechanical working, whereby a soap bar which does not undesirably form crystals upon use or storage is provided.

10. A process according to claim 9 wherein the electrolyte is potassium citrate.

* * * * *